United States Patent [19]

Kervizic et al.

[11] 4,047,482

[45] Sept. 13, 1977

[54] ELECTRONIC IGNITER CIRCUIT FOR DETONATING AN ELECTRIC PRIMER

[75] Inventors: Jean Kervizic, Versailles; Claude Deslandes, Saint-Mande; Alain Berson, St-Germain en Laye, all of France

[73] Assignee: Etat Francais, Paris, France

[21] Appl. No.: 622,395

[22] Filed: Oct. 14, 1975

[30] Foreign Application Priority Data

Oct. 11, 1974 France ..... 7434198

[51] Int. Cl.[2] ..... F42B 23/26; F42B 3/10; F42B 19/12

[52] U.S. Cl. ..... 102/19.2; 102/70.2 R

[58] Field of Search ..... 102/19.2, 70.2 R, 70.2 A

[56] References Cited

U.S. PATENT DOCUMENTS 3,721,885 3/1973 McKeown ..... 102/70.2 A 3,750,586 8/1973 Swallow et al. ..... 102/19.2

*Primary Examiner*—Samuel W. Engle
*Assistant Examiner*—Thomas H. Webb
*Attorney, Agent, or Firm*—Haseltine, Lake & Waters

[57] ABSTRACT

An electronic igniter circuit for an electric primer for the detonation of a pyrotechnical charge comprising a controlled semi-conductor element connected to the primer and a source of electrical energy to fire the primer when the semi-conductor element is rendered conductive. A condensor is connected in parallel to the source and the primer and a checking circuit for verifying the integrity of the igniter circuit and its elements is connected in parallel between the condensor and the primer. The checking circuit includes a voltage sensor which can be connected as a unit with the primer and connected via a cable to the igniter circuit at a remote location.

5 Claims, 2 Drawing Figures

FIG. 1
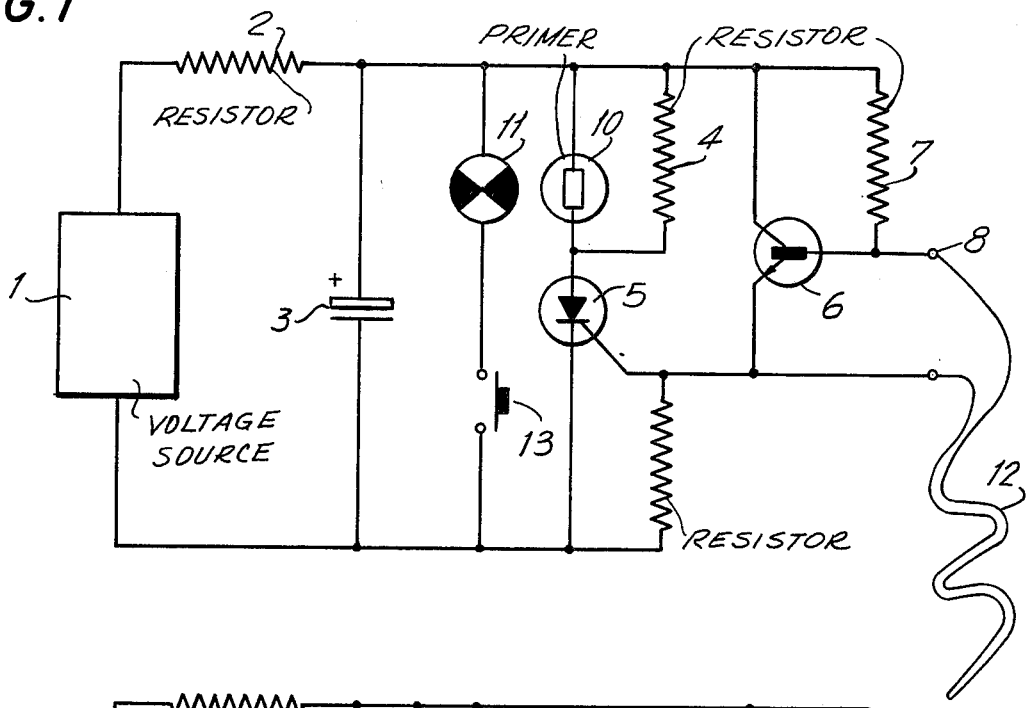
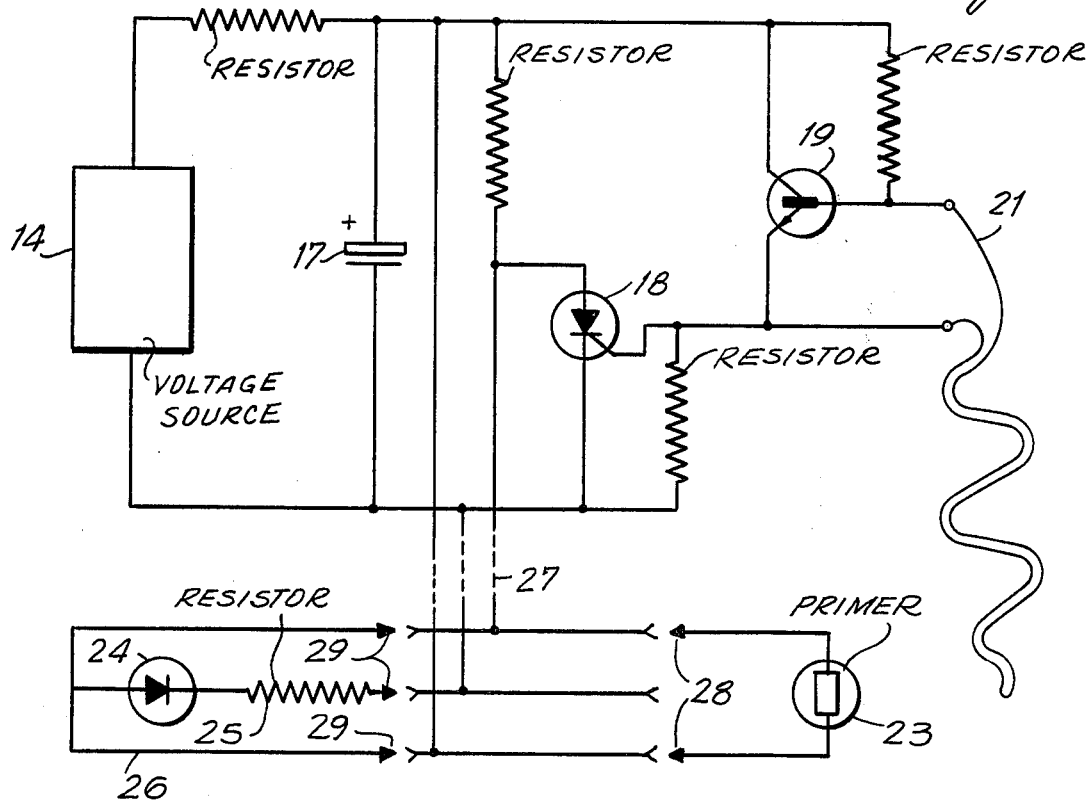
FIG. 2

ELECTRONIC IGNITER CIRCUIT FOR DETONATING AN ELECTRIC PRIMER

FIELD OF THE INVENTION

The invention relates to improvements in electronic igniter circuits for detonating pyrotechnical charges and particularly to improvements in the electrical circuits disclosed in U.S. Pat. No. 3,690,259.

BACKGROUND

The electronic igniter circuit of U.S. Pat. No. 3,690,259 produces the firing of pyrotechnical charges, such as, for example, mines by the rupture of a bifilar line of a filmentary conductor of electrical current of small section having similar characteristics of use as those mechanically required for the manufacture of tripping apparatus.

In the most simple configurations such as those disclosed in U.S. Pat. No. 3,690,259 and in French Pat. No. 159,718 the necessary controls to insure the integrity of the element associated with the base circuit do not present the desired or necessary security before arming on the part of a qualified operator requiring a substantial number of operations which impose the need of non-negligible time and careful attention.

An object of the invention is to provide apparatus which satisfies all of the safety test requirements and has only a minimum number of operations. The indication of readiness is obtained in a substantially instantaneous manner. The electroexplosive apparatus can remain permeanently, during this control, in disarmed state.

The present invention is characterized essentially in that an appropriate voltage sensor associated with the adaptation elements is connected to the terminals of a condensor or energy reservoir included in the main circuit connecting the elements concurrently at the firing of the prior explosive, the said condensor being disposed in parallel in a line of the principal circuit comprising the feed source mounted in series with a resistance.

BRIEF DESCRIPTION OF THE DRAWING

FIG. 1 is a circuit diagram of the electronic apparatus according to the invention, and FIG. 2 is a circuit diagram of another embodiment of the invention in which the control unit comprising a voltage sensor is disassociated from the physical assembly constituted by the elements of the main circuit. In this embodiment, the control unit comprises a shunt permitting short circuiting of the explosive primer and thus assuring security before arming of the electroexplosive assembly.

DETAILED DESCRIPTION

The principle of the invention is described hereafter with reference to FIG. 1.

In FIG. 1 is shown a circuit which embodies control means according to the invention and consisting essentially in the combination of a voltage sensor 11 connected in series with a switch 13, the circuit thus realized being connected in parallel with condensor 3 serving as an energy reservoir. The voltage sensor can be of any type whatsoever, viz, an incandescent bulb, a needle galvanometer, an "on-off" shutter, an electroluminescent diode, etc. The sensor is characterized by the voltage $V_2$ from which there is delivered a positive indication normally discernable to the operator, e.g.

illumination in the case of the incandescent bulb or electro-luminescent diode, or an angle of deviation in the case of a galvanometer.

If E is the electromotive force of energy source 1, R the value of the resistance of external resistor 2 plus the internal electrical resistance of the energy source as well as the circuit, and $r$ the electrical resistance of the voltage sensor 11, for a satisfactory operation of the apparatus it follows that:

$$(E \cdot r/R+r) \geqq V_2$$

At the time of use of such igniter circuit, the control means establishes the following:

electrical integrity of tripping wire 12 which must not have been cut at the time of placement;

the source 1 is in good electrical state and suitably connected with respect to the electrical contacts and polarities;

the condensor 3 is in good state and suitably charged to the required voltage;

the electronic circuit is ready for operation;

the members assuring the security of the operator are, before armament, in good operative state.

For the execution of the circuit which is the object of the present invention all these checks are almost simultaneously assured in the following manner:

1. In the case where the tripping wire 12 is not broken, transistor 6 is maintained blocked and thereby thyristor 5 is not conductive. The resistor 2 is not transversed by any current and, as a consequence, the voltage at the terminals of the condenser 3 is equal to the electromotive force from the source 1. When the operator closes the circuit of the voltage sensor 11 by means of the switch 13, a current flows in sensor 11 and the voltage at its terminals after several moments becomes:

$$(E \cdot r/R+r \geqq V_2$$

The sensor furnishes a positive indication.

2. If the tripping wire 12 is broken, the current in resistance 7 saturates the transistor which make the thyristor 5 conductive. A current flows in the resistor 2. When the operator closes the circuit of the voltage sensor 11 by means of the switch 13, the voltage drop in the resistor 2 is such that $V_2$ cannot be reached because resistor 4 is of much lower resistance value than $r$. The placement of resistor 4 of low resistance value in parallel with explosive primer 10 thereby simultaneously provides elimination of any risk of untimely detonation when the tripping wire is found broken before the connection of primer 10 and to obtain from the voltage sensor a null signal indicating a fault in the system.

If the source 1 is not in a good electrical state, its electromotive force will be too low to satisfy the expression $(Er/R+r) \geqq V_2$. The voltage $V_2$ will not be reached and the voltage sensor will not deliver a positive indication. The same is true if the electrical contacts are poorly established corresponding to an exaggerated increase in the value of R. If an accidental reversal of the polarities is made, no positive signal will be furnished in the case where the voltage sensor is realized by means of a polarized arrangement, viz, a galavanometer or electroluminescent diode. An incandescent bulb cannot alone always resolve this doubt and thus an electroluminescent diode can be connected in series in the proper sense. The control arrangement positively permits testing in the same manner a source of energy constituted not only of dry batteries but, for example, of an assembly of storage cells or accumulators having rapid or slow charge.

3. When the operator effects the trial by closing the control circuit through the switch 13, at this precise instant a voltage equal to the electromotive force E of the energy source 1 appears at the terminals of the sensor 11. This is a test of whether the condensor 3 is suitably charged and therefore in good state. The voltage sensor 11 should therefore furnish, in temporary fashion, an on-indication materialized by a brief flash if it is luminous or by an accentuated angular deviation if it is a galvanometer. This brief indication, very discernable in practice, and proportional to the energy emitted by the condensor, permits assuring the integrity of the element.

4. In order to insure the proper operation of the firing circuit when the voltage sensor is excited and furnishes a positive indication, it is sufficient to temporarily disconnect one end 8 of the tripping wire 12 which has the effect of saturating the transistor 6 which makes the thyristor 5 conductive. The intense current in the resistor 2 leads to a drop of voltage such that the potential at the terminals at the sensor 11 become lower than $V_2$. The sensor 11 thereby furnishes a null indication.

5. As shown by all of the preceding, the positive state of indication of the sensor assures the nonconduction of the thyristor 5 which controls the energization of the primer 10. The operator is therefore assured by this positive indication that no risk of untimely detonation can be produced during handling of associated electropyrotechnical sub-assemblies. This can be further confirmed by the means provided in the embodiments in FIG. 2.

According to the embodiment in FIG. 2, the voltage sensor, constituted by an electroluminescent diode 24 is connected in the form of a fixed assembly to a very low resistance short-circuit 26 connected in parallel to the explosive primer 23 for assuring the security, before armament, of the personnel responsible for the operation. A resistor 25 serves to assure the adoptation of the electroluminescent diode to the electrical characteristics of the firing circuit. The value of the resistor 25 is such that the expression $(E \cdot r/R+r) \geqq V_2$ will be satisfied when thyristor 18 does not conduct and the energy source 14 presents a sufficient electromotive force.

In this embodiment, given by way of non-limitative example, the control function is assured at a distance by the use of a three conductor cable 27. The explosive primer 23 is itself detachably connected to the extremity of this cable at contact studs 28 in order to intimately associate the active members to those assuring the security and the control. The role of switch 13 in FIG. 1 is satisfied by the connection of the fixed assembly to the extremity of the three conductor cable at detachable contact studs 29. The symmetrical organization of the control and the security units allows connection in one sense or the other without concern.

In this embodiment, it is possible to effect testing with the explosive primer 23 connected in circuit, but not linked up to the destructive charge, which permits assuring the validity of the security provided by the short circuit 26. In fact, when the primer 23 is not detonated after opening of the circuit of the tripping wire 21, the voltage sensor 24 gives a null indication. This positively indicates to the operator that the energy has been dissipated in the resistance shunt 26 and that this element is in proper state.

In the case of a bad connection or at the time of a disconnection, it is possible that the circuit 26 is not connected. The condensor then discharges through the assembly of the diode, the resistor 25 and the explosive primer.

The resistance 25 should therefore be chosen to render the intensity of current in its branch lower than the intensity of security current for the utilized explosive primer.

What is claimed is:

1. In an electronic igniter adapted to detonate a pyrotechnical charge by the rupture of a tripping wire comprising a direct current source, a first resistor connected to one terminal of said source, a primer, a condensor, said primer and condensor being connected in parallel to said source, and semi-conductor control means connected to the tripping wire and to said primer to detonate the latter when the tripping wire is ruptured, an improvement comprising control means for checking the functional integrity of the igniter, said control means including a voltage sensor connected in parallel to said condensor and to said primer, switch means connected in series with the voltage sensor, and an adaptation element connected to said voltage sensor as a unit assembly.

2. An electronic igniter as claimed in claim 1 wherein said primer is connected to said unit assembly.

3. An electronic igniter as claimed in claim 2 wherein said unit assembly comprises a shunt connecting said primer and voltage sensor for selectively short-circuiting said primer for testing security before arming.

4. An electronic igniter as claimed in claim 1 comprising an electrical cable connecting said assembly at a distance from the remainder of the igniter circuit.

5. An electronic igniter as claimed in claim 4 wherein the unit assembly is detachably connected to the cable.

* * * * *